United States Patent [19]

Stralow

[11] Patent Number: 4,962,701

[45] Date of Patent: Oct. 16, 1990

[54] BEVERAGE CAN CRUSHER

[76] Inventor: Cecil J. Stralow, 14672 Brookstone Dr., Poway, Calif. 92064

[21] Appl. No.: 520,497

[22] Filed: May 7, 1990

Related U.S. Application Data

[63] Continuation-in-part of Ser. No. 386,654, Jul. 31, 1989, abandoned.

[51] Int. Cl.[5] ..... B30B 15/30

[52] U.S. Cl. ..... 100/215; 100/280; 100/293; 100/902

[58] Field of Search ..... 100/902, 215, 242, 280, 100/283, 293

[56] References Cited

U.S. PATENT DOCUMENTS

| | | | |
|---|---|---|---|
| 3,062,130 | 11/1962 | Huber et al. | 100/902 X |
| 3,659,520 | 5/1972 | Garrett et al. | 100/902 X |
| 3,916,780 | 11/1975 | Heiser | 100/902 X |
| 4,188,875 | 2/1980 | Fabbri et al. | 100/902 X |
| 4,240,341 | 12/1980 | Whipple et al. | 100/902 X |
| 4,301,722 | 11/1981 | Balbo et al. | 100/902 X |
| 4,323,009 | 4/1982 | Voigt | 100/902 X |
| 4,403,545 | 9/1983 | Toburen et al. | 100/902 X |
| 4,542,689 | 9/1985 | Trolle | 100/902 X |
| 4,550,658 | 11/1985 | Trolle | 100/902 X |
| 4,827,840 | 5/1989 | Kane | 100/280 |

*Primary Examiner*—Harvey C. Hornsby
*Assistant Examiner*—Stephen F. Gerrity
*Attorney, Agent, or Firm*—Henderson & Sturm

[57] ABSTRACT

A crusher is provided for crushing typical beverage cans to shorten their height for facilitating disposal and recycling. An upright wall-mounted magazine carries a column of cans disposed with their lengths horizontally and the cans move gravitationally, one by one, into a crushing chamber in which a manually operated plunger functions to crush each can axially to a shortened length enabling it to drop from the crushing chamber into a waiting receptacle.

4 Claims, 3 Drawing Sheets

BEVERAGE CAN CRUSHER

This application is a continuation in part of copending application Ser. No. 386,654, filed Jul. 31, 1989, now abandoned.

BACKGROUND AND SUMMARY OF THE INVENTION

Many forms of can crushers are known in the prior art, some simple and some fairly complicated. The popularity of crushers results from the popularity of lightweight metal or like cans as containers for beverages, and it is typical that can dimensions have become relatively standardized in sizes including seven-ounce, twelve-ounce and sixteen-ounce, these being the sizes destined for return to the retailer, delivery to recycling centers and the like. Crushers offer the convenience of reducing the volume of returned cans to a fraction of the volume that would result if the cans retained their original dimensions.

U.S. Pat. No. 4,827,840 is typical of prior art relating to can crushers. In that patent, a horizontal crushing chamber receives a can and a lever-operated plunger compresses the can to a dimension enabling the can to be discharged through an opening dimensioned to allow passage of the crushed can.

Also in that patent, among other things, the cans are fed serially from a magazine but several drawbacks result from relatively complex structure, leading to elevated costs, difficult maintenance and such bulk as to make packaging and shipping inconvenient.

According to the present invention, these and other drawbacks are eliminated by the provision of a wall-mountable crusher that is simple and constructed of material having the characteristics of high strength and long life. Further, the design lends itself to knock-down shipping components that are easily assembled by the purchaser. A feature is the magazine that contains cans in serial mode for discharge one by one into the crushing chamber and for further discharge in crushed condition into a receptacle. A still further feature resides in the arrangement of parts providing for retention of the cans in the magazine during the crushing operation of a preceding can, the next can dropping into the crushing chamber upon retraction of the plunger to a position prior to the stroke on which it crushes the next can and so on. Yet another feature is the provision of a magazine selectively conditionable to handle cans of different dimensions.

A significant feature is that the crusher is provided as two units, the magazine being one unit and the crushing mechanism the other unit. By this feature, the magazine may be constructed of relatively light material since it takes no significant forces during operation of the device, while the crushing mechanism, which does by far the bulk of the work, can be made of heavier-duty material and can carry the pivot means for mounting the bell crank that operates the crushing plunger.

Other features relate to the ability of the crushing mechanism to adapt itself to handling individual cans at times and further to position cans that have been inadvertently dropped into the magazine in upright fashion.

These and other features and objects of the invention will appear as the disclosure progresses.

DETAILED DESCRIPTION OF A PREFERRED EMBODIMENT OF THE INVENTION

Figure 1:
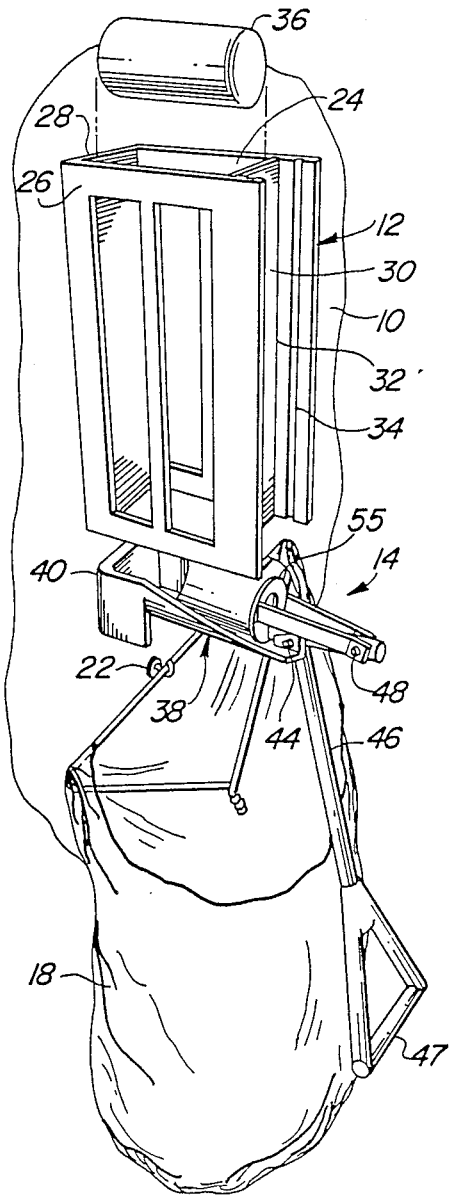
FIG. 1 is a perspective of the structure in operational mode.
Figure 3:
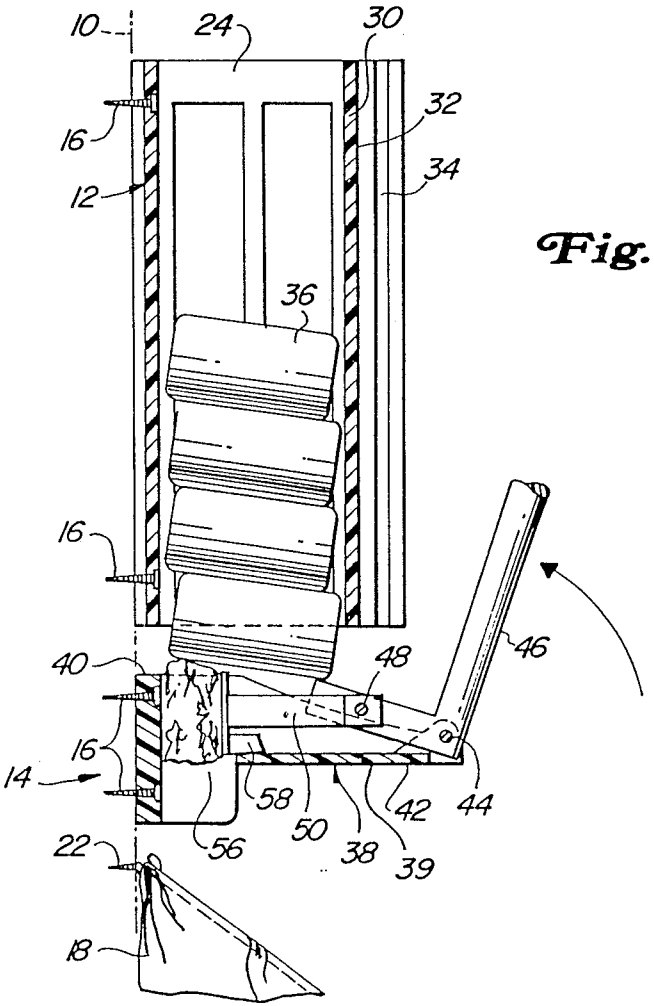
FIG. 3 is a similar view showing the plunger at the end of its crushing stroke.
Figure 2:
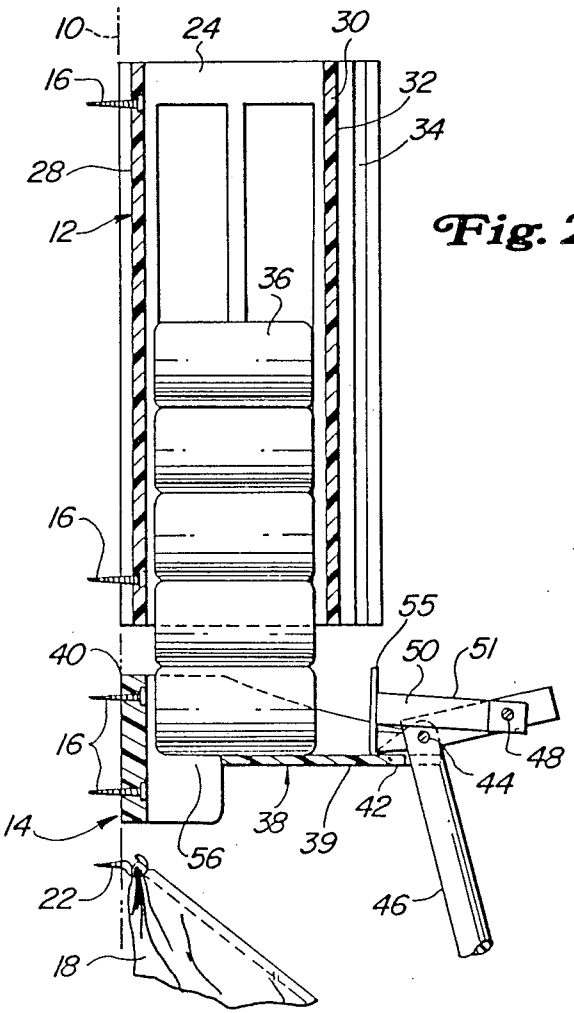
FIG. 2 is an enlarged elevation, partly in section, showing the crushing plunger on its retracted stroke.

Reference will be had first to FIG. 1 for an over-view of what is involved. The numeral 10 designates a wall or equivalent vertical support structure and the crusher, comprising a magazine unit 12 and crushing mechanism unit 14, is mounted on the wall by any suitable means, such as by screws 16 (FIGS. 2 and 3). A receptacle 18 is mounted on the wall below the crusher unit as by means of a modified wire coat hanger 20 and hooks 22 screwed into the wall. The receptacle may be a conventional plastic bag commonly used for trash, etc. In a preferred knocked-down shipping package, the magazine is in disassembled condition, as are the crushing components, and the bag 18, coat hanger and screws may be included in the package or furnished by the purchaser.

The magazine unit is structurally separate from the crusher unit and is made up of a plurality of walls 24, 26, 28 and 30 connectible in any suitable fashion to comprise the finished magazine. After assembly of the walls 24, 26 and 28, the screws 16 are used for mounting. The edge portions of the walls 24 and 26 remote from the wall 28 are provided with grooves 32 and 34 into either of which the wall 30 is receivable, depending upon the length of the cans contained in the magazine. In FIGS. 2 and 3, the magazine is shown as containing cans 36 of the typical twelve-ounce height. When the wall 30 is slid upwardly from the inner groove 32 and replaced in the outer groove 34, the magazine will hold cans of the sixteen-ounce size. Smaller cans, i.e., of the seven-ounce size are also available, albeit in lesser quantities; however, these can be crushed along with twelve-ounce cans when the magazine is in the twelve-ounce mode.

Figure 4:
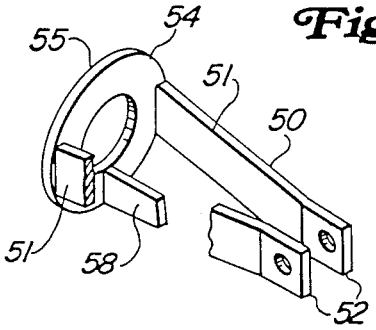
FIG. 4 is a perspective, with a portion broken away to show an interior part of the plunger.

The crushing mechanism 14 is wall-mounted directly beneath but separate from the open bottom of the magazine, again using screws 16. The crusher mechanism includes a base 38 in the form of an upwardly facing channel of approximately semi-circular section having a horizontal floor or bottom 39 and an integral inner end in the form of an upright flange 40 through which the screws 16 are passed into the wall. The base may be made of any suitable material of high strength and lightweight, such as aluminum, any of the well-known plastics, etc. The horizontal length of the base is somewhat more than the length of a sixteen-ounce can, and the base has an outer end 42 remote from the inner end 40 provided with a pivot 44 which mounts a bell-crank 46 whose long arm has a handle grip 47 and whose short arm is pivotally connected at 48 to a plunger 50, the configuration of which is seen in FIG. 4 as comprising a pair of arms 52 connected rigidly to a circular head 54 having a diameter on the order of that of a can to be crushed; or, in other words, fashioned to cooperate with the channeled base 38.

The pivot 44 is integral with the bottom 39 and rises therefrom to provide the pivot axis closely above the bottom, preferably at a height less than the diameter of a can, which provides better geometry for can crushing. Moreover, the pivot is directly a part of the crushing unit and thus separate from the magazine, thereby avoiding "beefing up" the magazine to provide an unnecessarily high pivot.

As will be seen from the description so far, the plunger is at the end of its retracted stroke when the bell-crank handle is down (FIG. 2). When the plunger is thus retracted, the lower-most can in the magazine is free to drop into the base between the head of the plunger and the inner end 40 of the base. Note in FIG. 2 that there is an axial space between the plunger head and the proximate end of the received twelve-ounce can. This will show the ability of the crusher to accommodate sixteen-ounce cans. When the bell-crank is rocked to the position of FIG. 3, the plunger crushes the can to the shorter length shown and the crushed can drops through a discharge opening 56 in the bottom of the base 38 and is thus received by the receptacle 18.

Figure 5:
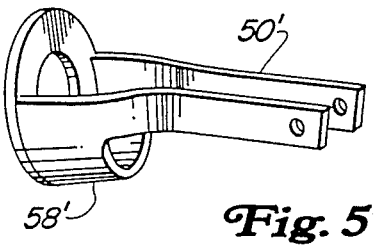
FIG. 5 is a similar view of a modified form of plunger.
Figure 6:
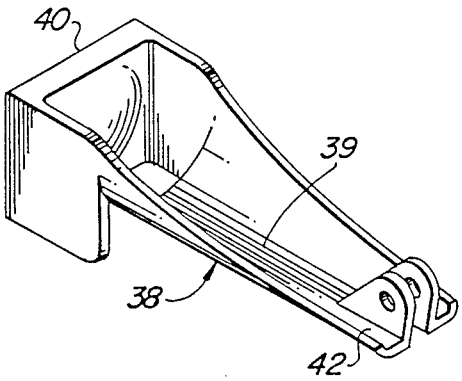
FIG. 6 is a perspective of the base of the crusher in which the plunger operates.

It should also be observed that the head of the plunger in FIG. 3 passes the edge of the discharge opening that is spaced from the end 40 of the base. However, a prong 58 on the plunger prevents the head from dropping into the opening 56 and hanging up on that edge. See also FIG. 4. It will also be seen in FIG. 3 that when the plunger is at the end of its crushing stroke, the next can from the magazine is prevented by the plunger arms from interfering with the retracting stroke of the plunger. But, when the plunger is fully retracted, the next can drops into place on the base 38. Again, on its next crushing stroke, the plunger prevents entry of more than one can at a time to the base 38. FIG. 5 shows a modified form of plunger 50' which has an arcuate underside 58' which functions like the prong 58 to prevent the plunger from hanging up on the edge of the discharge opening 56.

Figure 7:
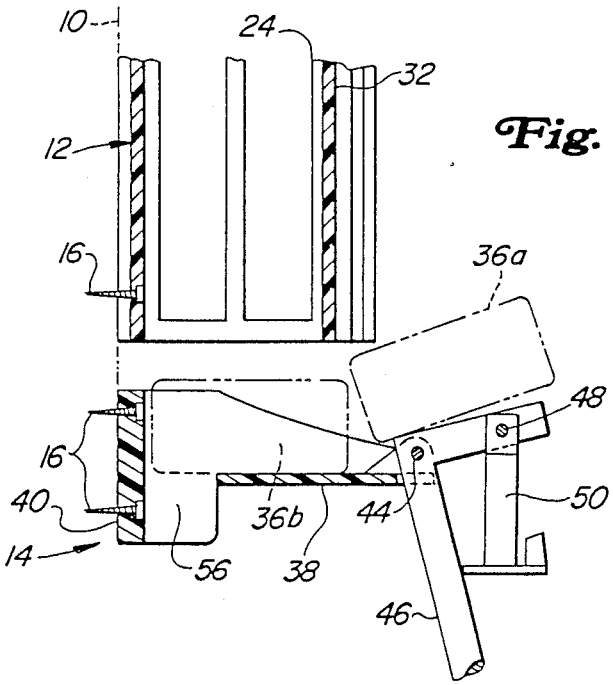
FIG. 7 is a fragmentary section showing how an individual can can be added or removed without passing through the magazine.
Figure 8:
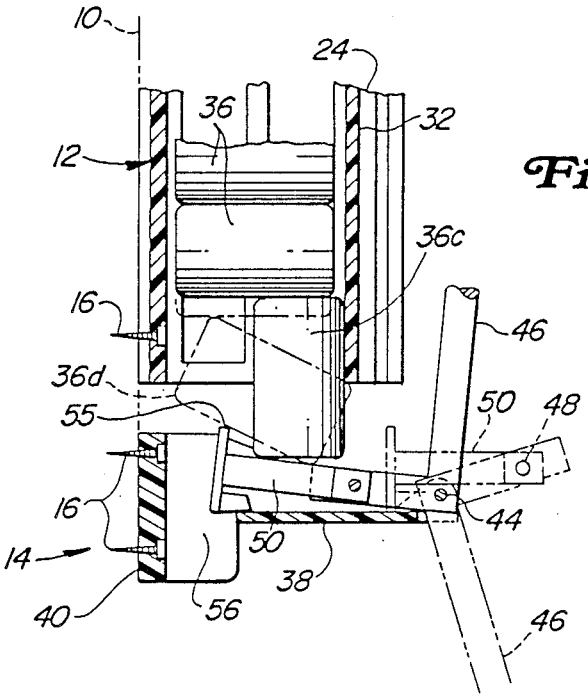
FIG. 8 is a fragmentary section showing how an upright can may be turned to a correct horizontal position by retraction of the plunger.

An important feature of the present design will be seen from FIG. 7, wherein the bell-crank is swung clock-wise to its maximum position which corresponds to the FIG. 2 position; thus, the bell-crank is in its plunger-retracted position. FIG. 7 shows, however, that the plunger has been swung clock-wise about its pivot 48 to expose the channel of the base 38, whereby a can may be manually added to or removed from the base as seen by the broken-line can positions **36*a* and 36*b*. That is to say, the lower exit end of the magazine is spaced sufficiently above the crushing unit to permit "flipping" of the plunger as shown. For example, during operation, the user may detect a can that for some reason he does not wish to crush. Thus he may slip the can 36*b* outwardly as suggested by the can 36*a* and thereby completely remove the can. Conversely, while the magazine is empty while adjusted for, say, twelve-ounce cans, the user may wish to crush one or two sixteen-ounce cans randomly, which he can do without adjusting the magazine, since he can insert a can as shown at 36*a* and 36*b*. This is another example of the versatility of the arrangement FIG. 8 illustrates a still further feature of the invention. As shown there, with the plunger in its crushing portion (full lines), a can 36*c* has been inadvertently dropped into the magazine and lands upright on the top of the plunger. This creates no problem, since retraction of the plunger via the bell-crank turns the can to a correct horizontal position. Thus result follows from the design of the plunger as best seen in FIGS. 4 and 8 wherein it is shown that the circular plunger head 54 has its top spaced above plunger arms 51 by a distance sufficient to give the plunger head an upper lip portion 55. The upright can 36*c* lands outwardly or to the right of the lip 55 (as seen in FIG. 8), so that when the plunger is retracted the lip engages the can and turns it to the 36*d* position from which the can gravitates to the correct horizontal position. It is seen that when the plunger is in its FIGS. 3 and 8 position, the lip 55 is disposed so that can 36*c* naturally slips to the right of the lip. The relationship of the lip 55 to the arms 51 is such as to form an upwardly facing "pocket" outwardly of the lip. The horizontal distance between the rear of the lip and the outer wall of the magazine is on the order of the diameter of a can but quite a bit less than the height of a can, so that a can dropped in an upright position is bound to drop outwardly of the lip 55 as shown. Further, the lip 55, in the crushing position of the plunger, is spaced from the end 40** of the base by a distance substantially less than a can diameter.

The leverage arrangement between the bell crank and the plunger is such as to prevent the plunger from climbing out of the base, so that the action of crushing is simple and smooth. As best noted by a comparison of FIGS. 2 and 3, the rear end of the bell crank (pivot 48) travels in an arc about the pivot 44 to pass upwardly and inwardly and over or past the pivot 44 and then inwardly and downwardly to the FIG. 3 position. At this point, the pivot 48 is just above a straight line between the pivot 44 and the center of the plunger head, thus exerting maximum force with fairly minimum effort. On return of the bell crank to its FIG. 2 position, the movement is relatively rapid and allows the next can to drop quickly into position to be crushed on the next stroke of the plunger. The pivots among the base, bell-crank and plunger are separable to contribute to the packaging of the structure for shipping, etc.

Features and advantages other than those enumerated will readily occur to those versed in the art, as will many modifications of the preferred embodiment disclosed, all without departing from the spirit and scope of the invention.

I claim:

1. A beverage can crusher including wall-mountable magazine for holding a vertical row of cans disposed in stacked relation with their lengths horizontal for serial discharge downwardly via a lower can-exit end, and a wall mountable can-crushing mechanism disposed below and for receiving cans from the magazine unit, characterized in that the crushing mechanism and magazines are structurally separate units and the crushing unit comprises a unitary horizontal base in the form of an upwardly-facing channel having a horizontal bottom and configured to receive a can lying lengthwise therein, said base having an upright inner end integral with and rising from the base bottom and adapted for mounting on a wall and an outer end spaced from said inner end a distance greater than the length of a can lying on the base bottom between said ends, said outer end having pivot means integral with and rising from the base bottom and providing a transverse pivot axis spaced closely above the base bottom, a plunger having an inner can-engaging end and also an outer end and riding lengthwise of the channel between a retracted position in which said can-crushing end is spaced at least a can length outwardly from the base inner end to a crushing position in which said can-crushing end is closely adjacent to the base inner end for shortening the axial length of a can, a bell crank pivotally mounted to said pivot means and including a short arm having a pivotal connection to the outer end of the plunger and a long arm connected to said short arm at said pivot means and said long arm being adapted for manual operation, said bell crank having plunger-retracted position in which the long arm extends downwardly from said pivot axis and the short arm extends .outwardly from said pivot axis, said bell crank being manually rockable about said pivot axis to move the plunger to its can-crushing position wherein the long arm moves upwardly and the short arm swings upwardly and inwardly and then downwardly and further inwardly as it passes an over-center position relative to the pivot axis.

2. The crusher according to claim 1, in which the lower end of the magazine is spaced sufficiently upwardly from the crushing mechanism so that, with the bell crank in its plunger-retracted position, the plunger may be manually swung upwardly and outwardly about its pivotal connection with the bell crank short arm to a position clear of the channel whereby a can may be manually laid in or removed from the channel without passing through the magazine.

3. The crusher according to claim 1, in which the magazine has a selectively positionable upright wall enabling the magazine to hold cans of different horizontal lengths.

4. The crusher according to claim 1, in which the inner end portion of the plunger is provided with an upwardly facing pocket for receiving a can in an upright position when the plunger is in its crushing position, and the inner end of the plunger has an upwardly directed lip defining the inner end of the pocket and adapted to engage an upright can for effecting turning of the can to a horizontal position when the plunger is retracted.

* * * * *